US011261643B2

(12) United States Patent
Kawase et al.

(10) Patent No.: US 11,261,643 B2
(45) Date of Patent: Mar. 1, 2022

(54) PINCH DETECTION SENSOR

(71) Applicant: Hitachi Metals, Ltd., Tokyo (JP)

(72) Inventors: Kenji Kawase, Tokyo (JP); Shuichi Suzuki, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 204 days.

(21) Appl. No.: 16/453,177

(22) Filed: Jun. 26, 2019

(65) Prior Publication Data

US 2020/0002990 A1 Jan. 2, 2020

(30) Foreign Application Priority Data

Jul. 2, 2018 (JP) ..... 2018-125807

(51) Int. Cl.
*E05F 15/42* (2015.01)
*B61D 19/02* (2006.01)
*E05F 15/44* (2015.01)

(52) U.S. Cl.
CPC ..... *E05F 15/42* (2015.01); *B61D 19/026* (2013.01); *E05F 15/44* (2015.01); *E05Y 2900/51* (2013.01); *E05Y 2900/531* (2013.01)

(58) Field of Classification Search
CPC ... B60J 10/40; B60J 10/00; B60J 10/80; B60J 10/86; E05F 15/42; E05F 15/40; E05F 15/44; B61D 19/026; E05Y 2900/531
See application file for complete search history.

(56) References Cited

U.S. PATENT DOCUMENTS 4,051,336 A * 9/1977 Miller ..... B60J 10/00 200/61.43
4,304,071 A * 12/1981 Obrecht ..... E05F 15/48 49/13
4,349,710 A * 9/1982 Miller ..... H01H 3/142 200/245
5,384,982 A * 1/1995 Galperin ..... F16P 3/12 200/61.43

(Continued)

FOREIGN PATENT DOCUMENTS

CH 688 354 A5 8/1997
DE 1 575 068 A2 9/2005

(Continued)

OTHER PUBLICATIONS

Extended European Search Report dated Oct. 11, 2019 for European Patent Application No. 19182815.1-1010.

*Primary Examiner* — Justin B Rephann
(74) *Attorney, Agent, or Firm* — McGinn I.P Law Group, PLLC

(57) ABSTRACT

A pinch detection device, for detecting the occurrence of pinch during closing of one pair of sliding doors, is composed of a first door front edge rubber to be attached to an edge portion in a closing movement direction of one sliding door of the one pair of sliding doors, and a second door front edge rubber to be attached to an edge portion in a closing movement direction of an other sliding door of the one pair of sliding doors. The first door front edge rubber includes a recessed portion, which is open toward the second door front edge rubber, with a linear shape pressure sensitive sensor, which is sensitive to a pressure in the event of pinch, being disposed in that recessed portion.

9 Claims, 5 Drawing Sheets

(56) References Cited

U.S. PATENT DOCUMENTS

| | | | | |
|---|---|---|---|---|
| 5,433,031 | A * | 7/1995 | Dailey | B60J 10/40 49/27 |
| 6,955,079 | B2 * | 10/2005 | Ishihara | E05F 15/44 318/445 |
| 7,603,813 | B2 * | 10/2009 | Hackl | E05F 15/42 49/120 |
| 8,061,084 | B2 * | 11/2011 | Katzensteiner | B60J 10/40 49/483.1 |
| 9,302,684 | B2 * | 4/2016 | Kawashima | B61D 19/00 |
| 9,849,767 | B2 * | 12/2017 | Salles | B60J 10/40 |
| 10,569,627 | B2 * | 2/2020 | Baba | B60J 10/40 |
| 10,844,645 | B2 * | 11/2020 | Hirtenlehner | E05F 15/44 |
| 2004/0140186 | A1 * | 7/2004 | Burgess | H01H 13/785 200/61.43 |
| 2009/0026709 | A1 * | 1/2009 | Katzensteiner | B60J 10/40 277/321 |
| 2011/0011004 | A1 * | 1/2011 | Courrian | B60J 10/40 49/483.1 |
| 2012/0267914 | A1 * | 10/2012 | Thiele | E05F 15/44 296/146.9 |
| 2015/0007745 | A1 * | 1/2015 | Kawashima | B61D 19/026 105/343 |

FOREIGN PATENT DOCUMENTS

| | | | |
|---|---|---|---|
| DE | 20 2004 006 968 | U1 | 9/2005 |
| FR | 2 944 503 | A1 | 10/2010 |
| JP | 2011-126368 | A | 6/2011 |
| JP | 5227299 | B2 | 7/2013 |
| JP | 2017-089247 | A | 5/2017 |
| WO | WO 2006/087131 | A1 | 8/2006 |

* cited by examiner

PINCH DETECTION SENSOR

CROSS-REFERENCE TO RELATED APPLICATION

The present application is based on Japanese patent application No. 2018-125807 filed on Jul. 2, 2018, the entire contents of which are incorporated herein by reference.

BACKGROUND OF THE INVENTION

1. Field of the Invention

The present invention relates to a pinch detection device for detecting the occurrence of pinch during closing of a sliding door.

2. Description of the Related Art

Conventionally, in a train vehicle doorway to allow passenger entry and exit, there are provided one pair of sliding doors that slide in train vehicle front and rear directions. Such train vehicle sliding doors are provided with a structure for detecting the occurrence of passenger's body or belongings pinch in the sliding doors during closing of the sliding doors (see, e.g., JP-A-2017-89247).

The door pinch detecting device described in JP-A-2017-89247 includes hollow door front edge rubber outer members, which are attached to front edges in closing movement directions of sliding doors, respectively, of a train vehicle, door front edge rubber inner members, which are insertably and removably accommodated in hollow portions of the door front edge rubber outer members respectively, and piezoelectric members, which are fixed to front edge portions of the door front edge rubber inner members, respectively, to act as a foreign object detection sensor. When foreign object pinch in the sliding doors occurs, the piezoelectric members transduce the deformation of the door front edge rubber inner members into an electric signal and output that electric signal, which is amplified and sent to an alarm device to generate an alarm. In response to that alarm, a trainman then opens the sliding doors to remove the pinched object.

Further, in the door pinch detecting device described in JP-A-2017-89247, front edge portions of the door front edge rubber outer members in the movement directions of the sliding doors during closing of the sliding doors are formed in an arch shape, with gaps being formed between inner surfaces of the front edge portions of the door front edge rubber outer members and perimeters of the piezoelectric members, respectively. The cushionabilities of the door front edge rubber outer members are then ensured by those gaps, resulting in impact relaxation when the door front edge rubber outer members collide with a passenger's body during closing of the sliding doors.

[Patent Document 1] JP-A-2017-89247

SUMMARY OF THE INVENTION

Now, in the sliding doors of the train vehicle, not only passenger's body pinch but also thin string-like object, passenger's wear, etc. pinch may occur. The string-like object pinch in the sliding doors may be caused, for example by passenger exiting from the train vehicle while carrying belongings with a main body object such as a pass case for holding cards being coupled to a tip of a string-like object. In such an event, in the door pinch detecting device described in JP-A-2017-89247, when the widths of the spaces between the inner surfaces of the front edge portions of the door front edge rubber outer members and the piezoelectric members in the one pair of sliding doors are greater than the width and thickness of the foreign object, the piezoelectric members may be acted on by no pressure, and no detection of occurrence of pinch may be able to be performed.

Accordingly, it is an object of the present invention to provide a pinch detection device with enhanced pinch detection accuracy during closing of sliding doors.

For the purpose of solving the above-described problem, the present invention provides a pinch detection device, for detecting the occurrence of pinch during closing of one pair of sliding doors, comprising: a first door front edge rubber to be attached to an edge portion in a closing movement direction of one sliding door of the one pair of sliding doors; and a second door front edge rubber to be attached to an edge portion in a closing movement direction of an other sliding door of the one pair of sliding doors, wherein the first door front edge rubber includes a recessed portion, which is open toward the second door front edge rubber, with a linear shape pressure sensitive sensor, which is sensitive to a pressure in the event of pinch, being disposed in that recessed portion.

Points of the Invention

The pinch detection device according to the present invention makes it possible to detect the occurrence of pinch in the sliding doors with higher accuracy.

DETAILED DESCRIPTION OF THE PREFERRED EMBODIMENTS

First Embodiment

Figure 1:
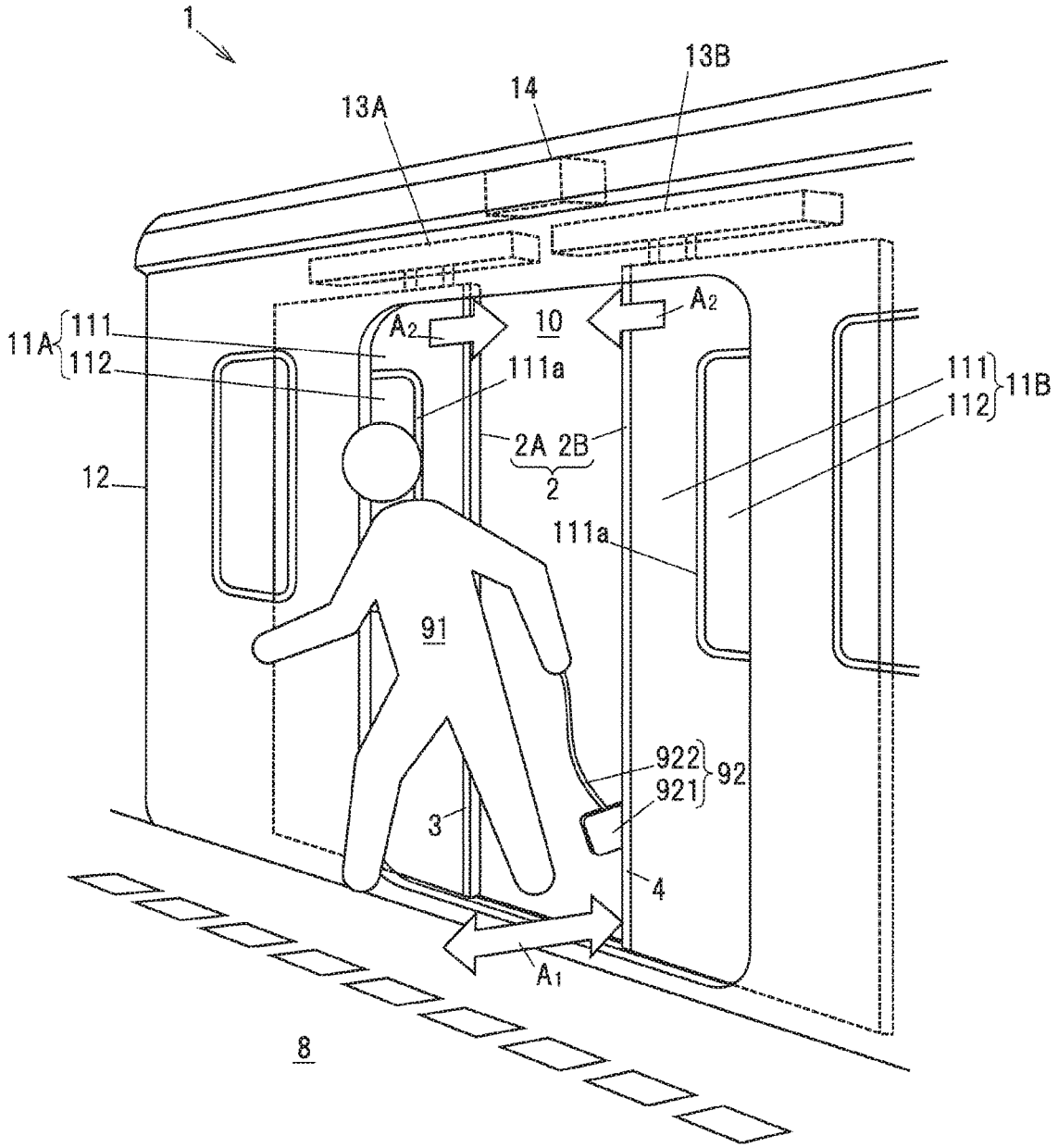
FIG. 1 is an explanatory view showing a train vehicle doorway with a pinch detection device according to an embodiment of the present invention attached to one pair of sliding doors thereof.

FIG. 1 is an explanatory view showing a doorway 10 of a train vehicle 1 with a pinch detection device 2 according to an embodiment of the present invention being attached to one pair of left and right sliding doors 11A and 11B of that doorway 10. In FIG. 1, there are shown a passenger 91 exiting from the train vehicle 1 to a station platform 8 and belongings 92 of the passenger 91. Further, in FIG. 1, entry and exit directions of the passenger 91 are indicated by arrows $A_1$, while moving directions (closing movement directions) during closing of the sliding doors 11A and 11B are indicated by arrows $A_2$.

The moving directions of the sliding doors 11A and 11B are parallel to a forward movement direction of the train vehicle 1. The entry and exit directions of the passenger 91 are perpendicular to the forward movement direction of the train vehicle 1 and parallel to thickness directions of the sliding doors 11A and 11B. The sliding doors 11A and 11B each include a respective door plate 111 and a respective window glass 112 fitted in a respective window section 111*a* of the respective door plate 111.

The belongings 92 include, for example, a main body object 921 such as a pass case for holding cards, and a string-like object 92 which is being coupled to the main body object 921 at one end thereof. The other end of the string-like object 92 is being gripped by the passenger 91. Note that the other end of the string-like object 92 may be suspended by a belt or the like of the passenger 91, for example.

By driving devices 13A and 13B which are provided in a vehicle body 12, the sliding doors 11A and 11B are slid in front and rear directions of the vehicle body 12 to open and close the doorway 10. The driving devices 13A and 13B are being disposed above the doorway 10, and are being configured to include a respective linear motion mechanism such as a linear motor and a ball screw, for example. The driving devices 13A and 13B are controlled by a control device 14. The movement ranges (the positions of forward and backward movement ends) of the sliding doors 11A and 11B are defined by stoppers (not shown) which are provided in the driving devices 13A and 13B.

The pinch detection device 2 includes a first pinch detection sensor 2A, which is attached to one sliding door 11A, and a second pinch detection sensor 2B, which is attached to the other sliding door 11B. The first and second pinch detection sensors 2A and 2B are being vertically attached to respective edge portions of the sliding doors 11A and 11B, and during closing of the sliding doors 11A and 11B, in the event of pinch of the passenger 91 or their belongings 92 therebetween, the first and second pinch detection sensors 2A and 2B detect that occurrence of pinch. When the control device 14 receives a signal indicating that occurrence of pinch from the pinch detection device 2, the control device 14 controls the driving devices 13A and 13B to open the sliding doors 11A and 11B. Note that when the control device 14 receives a signal indicating the occurrence of pinch from the pinch detection device 2, the control device 14 may generate an alarm signal to give an alarm to a trainman such as a driver or a conductor. In this case, the sliding doors 11A and 11B are opened by being operated by the trainman.

Figure 2:
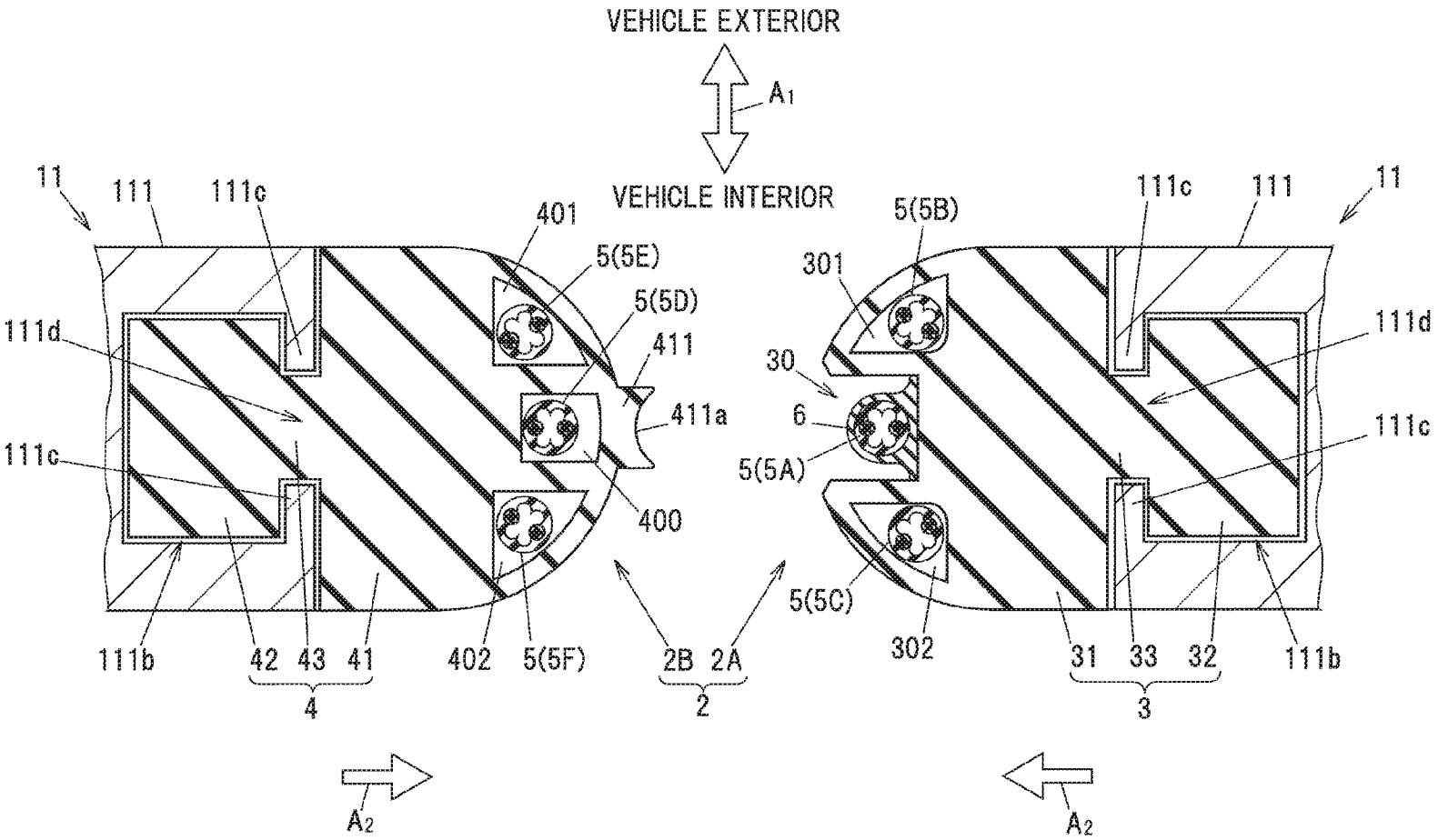
FIG. 2 is a cross-sectional view showing the pinch detection device.

FIG. 2 is a cross-sectional view showing the first and second pinch detection sensors 2A and 2B. In FIG. 2, the first and second pinch detection sensors 2A and 2B are indicated by cross sections parallel to the entry and exit directions $A_1$ of the passenger 91 and the closing movement directions $A_2$ of the sliding doors 11A and 11B (in other words, cross sections at right angles to longitudinal directions of the first and second pinch detection sensors 2A and 2B). Further, in FIG. 2, the upper side of the drawing corresponds to the vehicle exterior side (platform 8 side) of the train vehicle 1, while the lower side of the drawing corresponds to the vehicle interior side.

The pinch detection device 2 includes a first door front edge rubber 3, which is attached to the edge portion in the closing movement direction of one sliding door 11A, and a second door front edge rubber 4, which is attached to the edge portion in the closing movement direction of the other sliding door 11B, and a plurality of pressure sensitive sensors 5, which are sensitive to a pressure. The pressure sensitive sensors 5 are formed in a linear shape, and extend in the vertical directions of the sliding doors 11A and 11B.

In the present embodiment, the pinch detection device 2 is being provided with six pressure sensitive sensors 5. Hereinafter, in order to distinguish each of these pressure sensitive sensors 5, the six pressure sensitive sensors 5 are referred to as first to sixth pressure sensitive sensors 5A to 5F. Of the six pressure sensitive sensors 5, the first to third pressure sensitive sensors 5A to 5C are being disposed for the first door front edge rubber 3, while the fourth to sixth pressure sensitive sensors 5D to 5 F are being disposed for the second door front edge rubber 4.

Further, the pinch detection device 2 includes a holding member 6 made of an elastic body that holds the first pressure sensitive sensor 5A. The holding member 6 is holding the first pressure sensitive sensor 5A on an exterior of the first door front edge rubber 3. The configurations of the pressure sensitive sensor 5 and the holding member 6 will be described later.

The door plates 111 of the sliding doors 11A and 11B are being vertically formed with respective mating grooves 111*b* for attaching the first and second door front edge rubbers 3 and 4 respectively. The mating grooves 111*b* are open in the closing movement directions of the sliding doors 11 through respective openings 111*d* between respective one pairs of protruding pieces 111*c* and 111*c* opposite each other.

The first door front edge rubber 3 integrally includes a base section 31, which is disposed in the closing direction of one sliding door 11A relative to the one pair of protruding pieces 111*c* and 111*c*, a mating portion 32, which is mated into the mating groove 111*b*, and a connecting portion 33, which connects the base section 31 and the mating portion 32. Likewise, the second door front edge rubber 4 integrally includes a base section 41, which is disposed in the closing direction of the other sliding door 11B relative to the one pair of protruding pieces 111*c* and 111*c*, a mating portion 42, which is mated into the mating groove 111*b*, and a connecting portion 43, which connects the base section 41 and the mating portion 42. The first and second door front edge rubbers 3 and 4 are made of, for example, urethane rubber, EP rubber, silicone rubber, styrene butadiene rubber, chloroprene rubber, olefin based or styrene based thermoplastic elastomer, urethane resin or the like, and are formed by extrusion molding.

The first door front edge rubber 3 includes a recessed portion 30, which is open toward the second door front edge rubber 4, in an edge portion of the base section 31 in the closing movement direction of one sliding door 11A and in a middle portion in the thickness direction of one sliding door 11A. The holding member 6 is being disposed on a bottom of the recessed portion 30. The second door front edge rubber 4 includes a protrusion 411, which is mated into the recessed portion 30 of the first door front edge rubber 3 during closing of the one pair of sliding doors 11A and 11B. A tip surface 411*a* of the protrusion 411 is being formed in a concave curve shape. The protrusion 411 including the tip surface 411*a* is at least partially mated into the recessed portion 30.

The first door front edge rubber 3 includes hollow spaces 301 and 302 in the vehicle exterior side and the vehicle interior side, respectively, relative to the recessed portion 30. A second pressure sensitive sensor 5B that is sensitive to a pressure from the vehicle exterior side relative to the recessed portion 30 is being disposed in the hollow space 301 in the vehicle exterior side. A third pressure sensitive sensor 5C that is sensitive to a pressure from the vehicle interior side relative to the recessed portion 30 is being disposed in the hollow space 302 in the vehicle interior side.

The second door front edge rubber 4 includes a hollow space 400 in a rear position of the protrusion 411 in the closing movement direction of the other sliding door 11B. Further, the second door front edge rubber 4 includes hollow spaces 401 and 402 in the vehicle exterior side and the vehicle interior side, respectively, relative to the rear position of the protrusion 411 in the closing movement direction of the other sliding door 11B. Fourth to sixth pressure sensitive sensors 5D to 5F are being disposed in the hollow spaces 400, 401, and 402, respectively. The fourth pressure sensitive sensor 5D disposed in the hollow space 400 is sensitive to a pressure from the protrusion 411 in the event of pinch in the closing movement direction of the sliding door 11B. The fifth pressure sensitive sensor 5E disposed in the hollow space 401 in the vehicle exterior side is sensitive to a pressure from the vehicle exterior side relative to the protrusion 411. The sixth pressure sensitive sensor 5F disposed in the hollow space 402 in the vehicle interior side is sensitive to a pressure from the vehicle interior side relative to the protrusion 411.

The second and fifth pressure sensitive sensors 5B and 5E are compressed, for example, in the event of passenger collision therewith from the vehicle exterior side during closing of the sliding doors 11A and 11B, while the third and sixth pressure sensitive sensors 5C and 5F are compressed, for example, in the event of passenger collision therewith from the vehicle interior side during closing of the sliding doors 11A and 11B.

Figure 3:
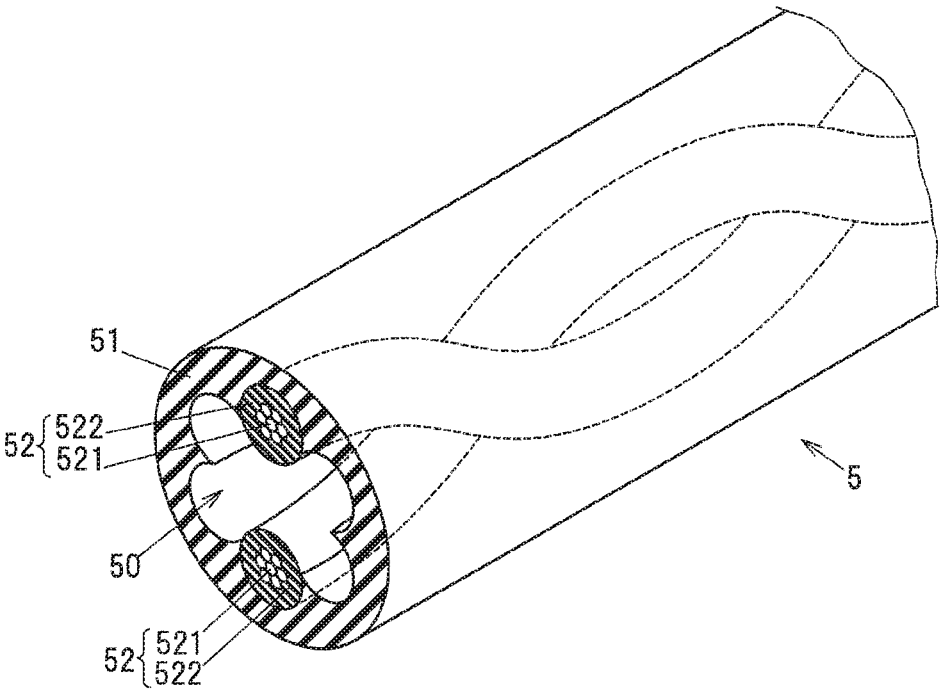
FIG. 3 is a perspective view showing a pressure sensitive sensor 5.

FIG. 3 is a perspective view showing the pressure sensitive sensor 5. The pressure sensitive sensor 5 includes a tube 51 which is formed of a tubular elastic body, and a plurality of conductor wires 52 which are spaced apart from each other in an inner side of that tube 51. More specifically, two conductor wires 52 are being helically held on an inner surface of the tube 51 while being partially exposed, with a space 50 being formed in a central portion of the tube 51. The tube 51 is made of, for example, an insulating rubber material such as silicone rubber or ethylene propylene rubber, and has such elasticity as to be deformed by being acted on by an external force, and restored immediately no external force is exerted.

In a natural condition of the tube 51 when acted on by no external force, the plurality of conductor wires 52 are being held in non-contact with each other with the space 50 therebetween. Further, the tube 51 when acted on by an external force is elastically deformed to bring the plurality of conductor wires 52 into contact with each other. In each of the conductor wires 52, a metal stranded wire 521 with multiple metal wires stranded together is being covered with a conductive covering layer 522. This structure allows the pressure sensitive sensor 5 to sense external pressure forces in all radial directions of the tube 51.

Note that the number of conductor wires 52 held in the tube 51 is not limited to two, but may be four, for example. Further, although in the present embodiment, the six pressure sensitive sensors 5 are common in structure and size, they are not limited thereto, but for example, the first pressure sensitive sensor 5A may be greater or smaller in diameter than the second to sixth pressure sensitive sensors 5B to 5F. Furthermore, the plurality of conductor wires 52 may not helically be held, but may be held parallel to each other and perpendicular to the pressure sensing directions. In this case, the conductor wires 52 may be formed in a band shape.

Figure 4A:
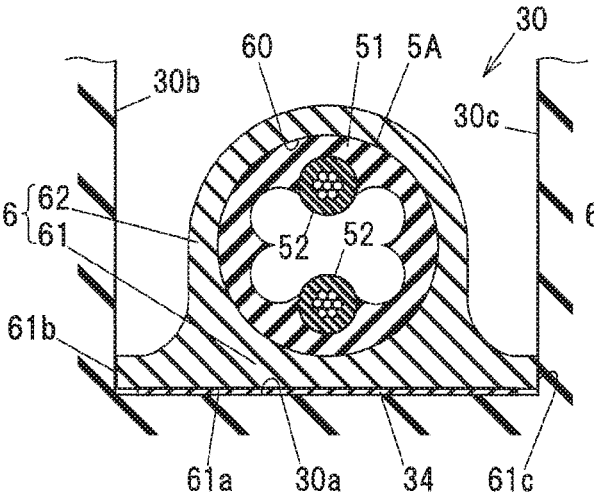
FIG. 4A is a cross-sectional view showing a holding member and its surroundings in a natural condition when acted on by no pressure.
Figure 4B:
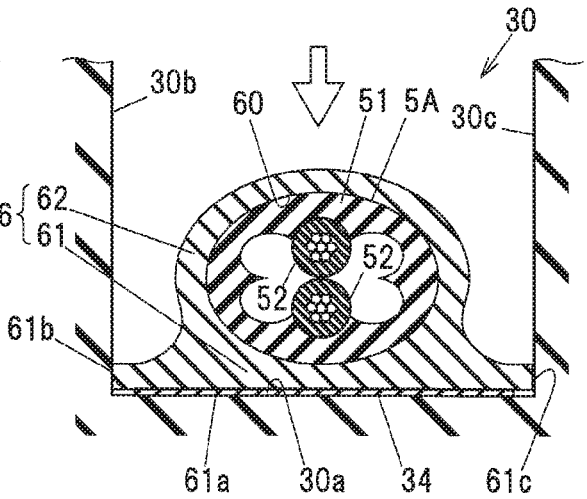
FIG. 4B is a cross-sectional view showing the holding member and its surroundings in a compressed condition when acted on by a pressure.

FIG. 4A is a cross-sectional view showing the holding member 6 and its surroundings in a natural condition when acted on by no pressure. FIG. 4B is a cross-sectional view showing the holding member 6 and its surroundings in a compressed condition when acted on by a pressure.

The holding member 6 is made of, e.g., urethane rubber, EP rubber, silicone rubber, styrene butadiene rubber, chloroprene rubber, olefin based or styrene based thermoplastic elastomer, urethane resin or the like, and the holding member 6 integrally includes a base section 61, which is attached to a bottom surface 30*a* of the recessed portion 30, and a cylindrical holding portion 62, which is formed with a hollow portion 60 in a central portion thereof. In the hollow portion 60, the first pressure sensitive sensor 5A is accommodated. In the illustrated example of FIGS. 4A and 4B, the bottom surface 61*a* of the base section 61 is fixed to the bottom surface 30*a* of the recessed portion 30 with a double-sided tape 34. It should be noted, however, that the base section 61 is not limited to this, but may be fixed with an adhesive, for example.

A thickness of the holding portion 62 is being formed thinner than thicknesses between inner surfaces of the hollow spaces 301 and 302 of the first door front edge rubber 3 and an outer surface of the first door front edge rubber 3. This makes the first pressure sensitive sensor 5A highly sensitive even to a slight pressure.

A width of the base section 61 in the thickness direction of the sliding door 11A is wider than a width of the holding portion 62 in the same thickness direction, and the first pressure sensitive sensor 5A is being positioned in the thickness direction of the sliding door 11A by the base section 61. In the illustrated example of FIGS. 4A and 4B, side surfaces 30*b* and 30*c* of the recessed portion 30, and end faces 61*b* and 61*c* of the base section 61, which are facing those side surfaces 30*b* and 30*c* respectively, are in elastic contact with each other, but slight gaps may respectively be formed between the side surfaces 30*b* and 30*c* of the recessed portion 30 and the end faces 61*b* and 61*c* of the base section 61.

Gaps are being formed between the holding portion 62 and the side surfaces 30*b* and 30*c*, respectively, of the recessed portion 30. As shown in FIG. 4B, those gaps act as clearance spaces for the holding portion 62 when the holding member 6 is compressed. The first pressure sensitive sensor 5A is sensitive to the pressure in the event of pinch in the sliding doors 11A and 11B, by being compressed by the holding member 6 being compressed from the opening side of the recessed portion 30, in such a manner as to bring the plurality of conductor wires 52 into contact with each other.

Figure 5:
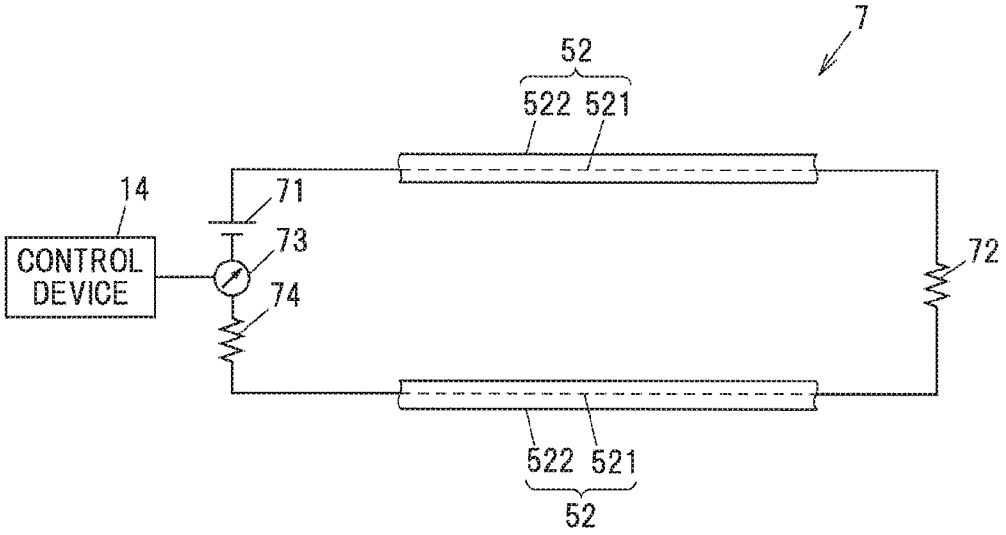
FIG. 5 is a circuit diagram showing one example of an electric circuit for detecting the occurrence of pinch in the sliding doors with a pressure sensitive sensor.

FIG. 5 is a circuit diagram showing one example of an electric circuit 7 for detecting the occurrence of pinch with the pressure sensitive sensor 5. This electric circuit 7 is being configured to include the two conductor wires 52 of the pressure sensitive sensor 5, and includes a power source 71, a contact detection resistor 72 that connects together end portions of the two conductor wires 52, an ammeter 73 and a current limitation resistor 74 that are connected in series with the power supply 71. The ammeter 73 includes, for example, a current sensor such as a Hall IC and an amplifier, and its detection signal is output to the control device 14.

In the electric circuit 7 configured as described above, when the pressure sensitive sensor 5 is compressed and the conductor wires 52 are brought into contact with each other, electric current to be detected by the ammeter 73 varies. The control device 14 recognizes the occurrence of pinch in the sliding doors 11A and 11B from the variation of the detection signal of the ammeter 73, and stops or reverses the driving devices 13A and 13B.

Note that although in FIG. 5 the electric circuit 7 is shown for only one pressure sensitive sensor 5, since in the present embodiment, the pinch detection device 2 has the six pressure sensitive sensors 5, each of the pressure sensitive sensors 5 is being provided with its respective electric circuit 7, and the detection signals of the ammeters 73 of their respective electric circuits 7 are output to the control device 14. The control device 14 when recognizing the occurrence of compression of any of the pressure sensitive sensors 5 reverses the driving devices 13A and 13B.

Figure 6A:
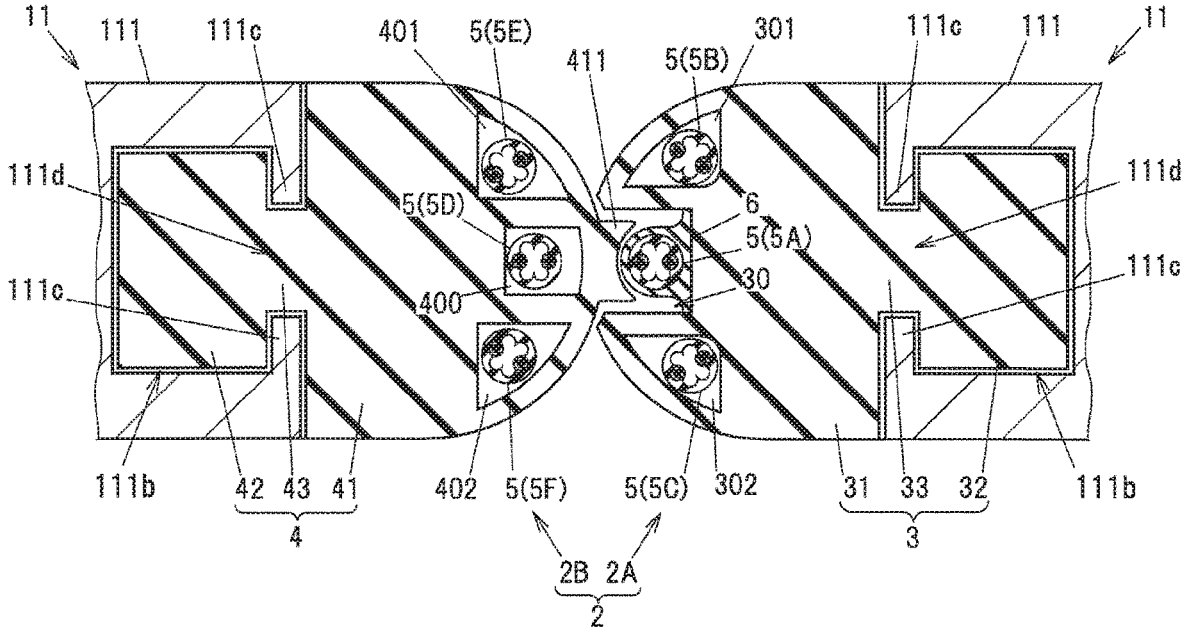
FIG. 6A shows the sliding doors closed without occurrence of pinch.
Figure 6B:
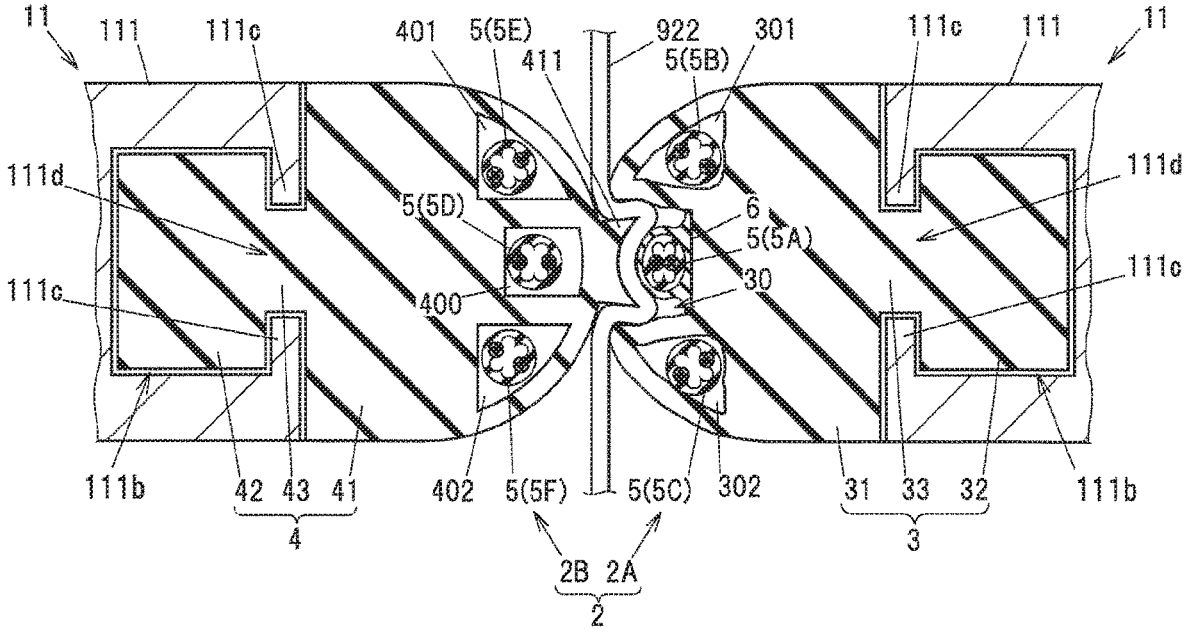
FIG. 6B shows the sliding doors closed with a string-like object of belongings being pinched therein during closing of the sliding doors.

FIG. 6A shows the sliding doors 11A and 11B closed without occurrence of pinch. FIG. 6B shows the sliding doors closed with the string-like object 922 of the belongings 92 being pinched therein between the first and second door front edge rubbers 3 and 4 during closing of the sliding doors 11A and 11B.

As shown in FIG. 6A, when the sliding doors 11A and 11B are closed, the protrusion 411 of the second door front edge rubber 4 mates into the recessed portion 30 of the first door front edge rubber 3. This results in enhancement in the vehicle interior airtightness of the train vehicle 1, and besides, suppression of occurrence of rattling of the sliding doors 11A and 11B. Note that, with no pinch occurring, the tip surface 411*a* of the protrusion 411 is not brought into contact with the holding member 6, so the first pressure sensitive sensor 5A is not pressed.

On the other hand, as shown in FIG. 6B, during closing of the sliding doors 11A and 11B, when the string-like object 922 of the belongings 92 is pinched therebetween, the string-like object 922 is pushed into the recessed portion 30 of the first door front edge rubber 3 by the protrusion 411 of the second door front edge rubber 4, in such a manner as to compress the first pressure sensitive sensor 5A held in the holding member 6. This results in bringing the conductor wires 52 of the first pressure sensitive sensor 5A into contact with each other, and detecting the occurrence of that pinch with the control device 14. The control device 14, when detecting the occurrence of that pinch with the first pressure sensitive sensor 5A, controls the driving devices 13A and 13B to open the sliding doors 11A and 11B. This results in releasing the string-like object 922.

Advantageous Effects of the First Embodiment

According to the first embodiment described above, the following operations and advantageous effects (1) to (3) can be obtained.

(1) Since the first door front edge rubber 3 has the recessed portion 30 which is open toward the second door front edge rubber 4, and the first pressure sensitive sensor 5A is being disposed in the recessed portion 30, for example when the string-like object 922 of the belongings 92 is pinched between the first door front edge rubber 3 and the second door front edge rubber 4, the string-like object 922 is pushed into the recessed portion 30, resulting in detecting the occurrence of that pinch. This allows the pinch detection with high accuracy. In addition, since the first pressure sensitive sensor 5A is being arranged within the recessed portion 30, the first pressure sensitive sensor 5A is unlikely to detach from the first door front edge rubber 3 even when the passenger 91' body or wear rubs against the front edge portion of the first door front edge rubber 3 during entry and exit.

(2) Since the first pressure sensitive sensor 5A is being disposed within the recessed portion 30 by being held in the holding member 6 having the base section 61 fixed to the bottom surface 30*a* of the recessed portion 30, the first pressure sensitive sensor 5A is securely held while being high precision positioned within the recessed portion 30. In addition, because of the gaps between the holding portion 62 and the side surfaces 30*b* and 30*c* of the recessed portion 30, the elastic deformation of the holding member 6 resulting from compression is not disrupted, so the pressure due to pinch is highly likely to be transmitted to the first pressure sensitive sensor 5A.

(3) Since the second door front edge rubber 4 has the protrusion 411 to be mated into the recessed portion 30, for example even when the thickness of a pinch detection target object such as the string-like object 922 of the belongings 92 or the passenger 91' wear is thin, the detection target object is pushed into the recessed portion 30, thereby making it possible to securely detect the occurrence of pinch in the sliding doors 11A and 11B.

(4) Since the pinch detection device 2 includes the second to sixth pressure sensitive sensors 5B to 5F as well as the first pressure sensitive sensor 5A, the pinch detection device 2 is able to be sensitive to pressures from various directions.

SUMMARY OF THE EMBODIMENTS

Next, the technical ideas grasped from the above-described embodiments will be described with the aid of the reference characters and the like in the embodiments. It should be noted, however, that each of the reference characters in the following descriptions is not to be construed as limiting the constituent elements in the claims to the members and the like specifically shown in the embodiments.

[1] A pinch detection device (2), for detecting the occurrence of pinch during closing of one pair of sliding doors (11A, 11B), comprising: a first door front edge rubber (3) to be attached to an edge portion in a closing movement direction of one sliding door (11A) of the one pair of sliding doors (11A, 11B); and a second door front edge rubber (4) to be attached to an edge portion in a closing movement direction of an other sliding door (11B) of the one pair of sliding doors (11A, 11B), wherein the first door front edge rubber (3) includes a recessed portion (30), which is open toward the second door front edge rubber (4), with a linear shape pressure sensitive sensor (5A), which is sensitive to a pressure in the event of pinch, being disposed in that recessed portion (30).

[2] The pinch detection device (2) according to [1] above, further including a holding member (6) comprising an elastic body with a hollow portion (60) therein, with the pressure sensitive sensor (5A) disposed in the recessed portion (30) being accommodated and held in that hollow portion (60), wherein the holding member (6) integrally includes a base section (61), which is attached to a bottom surface (30*a*) of the recessed portion (30) and a cylindrical holding portion (62), which is formed with the hollow portion (60) in a central portion thereof, with a width of the base section (61) in a thickness direction of the one sliding door (11A) being wider than a width of the holding portion (62) in the same thickness direction, with the pressure sensitive sensor (5A) being positioned in the thickness direction of the one sliding door (11A) by the base section (61), with gaps being formed between the holding portion (62) and side surfaces (30*b*, 30*c*), respectively, of the recessed portion (30).

[3] The pinch detection device (2) according to the above [1] or [2], wherein the first door front edge rubber (3) includes a hollow space (301) in a vehicle exterior side relative to the recessed portion (30), with a linear shape pressure sensitive sensor (5B), which is sensitive to a pressure from the vehicle exterior side relative to the recessed portion (30), being disposed within that hollow space (301).

[4] The pinch detection device (2) according to any one of the above [1] to [3], wherein the first door front edge rubber (3) includes a hollow space (302) in a vehicle interior side relative to the recessed portion (30), with a linear shape pressure sensitive sensor (5C), which is sensitive to a pressure from the vehicle interior side relative to the recessed portion (30), being disposed within the hollow space (302).

[5] The pinch detection device (2) according to any one of the above [1] to [4], wherein the second door front edge rubber (4) includes a protrusion (411) to be at least partially mated into the recessed portion (30) during closing of the one pair of sliding doors (11A, 11B).

[6] The pinch detection device (2) according to [5] above, wherein the second door front edge rubber (4) includes a hollow space (400) in a rear position of the protrusion (411) in the closing movement direction of the other sliding door (11B), with a linear shape pressure sensitive sensor (5D), that is sensitive to a pressure from the protrusion (411) in the event of pinch in that closing movement direction, being disposed within that hollow space (400).

[7] The pinch detection device (2) according to the above [5] or [6], wherein the second door front edge rubber (4) includes a hollow space (401) in the vehicle exterior side relative to a rear position of the protrusion (411) in the closing movement direction of the other sliding door (11B), with a linear shape pressure sensitive sensor (5E), that is sensitive to a pressure from the vehicle exterior side relative to the protrusion (411), being disposed within that hollow space (401).

[8] The pinch detection device (2) according to any one of the above [5] to [7], wherein the second door front edge rubber (4) includes a hollow space (402) in the vehicle interior side relative to the rear position of the protrusion (411) in the closing movement direction of the other sliding door (11B), with a linear shape pressure sensitive sensor (5F), that is sensitive to a pressure from the vehicle interior side relative to the protrusion (411), being disposed within that hollow space (402).

Although the embodiments of the present invention have been described above, the above described embodiments are not to be construed as limiting the inventions according to the claims. It should also be noted that not all combinations of the features described in the embodiments are indispensable to the means for solving the problem of the invention. For example, some or all of the second to sixth pressure sensitive sensors 5B to 5F may be omitted.

Further, the present invention can appropriately be modified and implemented without departing from the spirit thereof. For example, although in the above described embodiments, there has been described the case where the present invention is applied to the sliding doors 11 for opening and closing the doorway 10 of the train vehicle 1, the present invention is not limited thereto, but may also be applied to, for example so-called home door sliding doors which are provided on the platform 8 and which are opened after arrival of the train vehicle 1 and closed before departure of the train vehicle 1.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A pinch detection device, for detecting an occurrence of pinch during closing of one pair of sliding doors, comprising:

a first door front edge rubber to be attached to an edge portion in a closing movement direction of one sliding door of the one pair of sliding doors; and a second door front edge rubber to be attached to an edge portion in a closing movement direction of an other sliding door of the one pair of sliding doors, wherein the first door front edge rubber includes a recessed portion, which is open toward the second door front edge rubber, with a linear shape pressure sensitive sensor, which is sensitive to a pressure in an event of pinch, being disposed in that recessed portion, wherein the pinch detection device further includes a holding member comprising an elastic body with a hollow portion therein, with the pressure sensitive sensor disposed in the recessed portion being accommodated and held in that hollow portion, which holds the pressure sensitive sensor on an exterior of the first door front edge rubber, wherein the second door front edge rubber includes a protrusion to be at least partially mated into the recessed portion during closing of the one pair of sliding doors, and wherein the protrusion of the second door front edge rubber includes a tip surface formed in a concave curved shape on a surface of the protrusion of the second door front edge rubber.

2. The pinch detection device according to claim 1, wherein the holding member integrally includes a base section, which is attached to a bottom surface of the recessed portion and a cylindrical holding portion, which is formed with the hollow portion in a central portion thereof, with a width of the base section in a thickness direction of the one sliding door being wider than a width of the holding portion in the same thickness direction, with the pressure sensitive sensor being positioned in the thickness direction of the one sliding door by the base section, with gaps being formed between the holding portion and side surfaces, respectively, of the recessed portion.

3. The pinch detection device according to claim 1, wherein the first door front edge rubber includes a hollow space in a vehicle exterior side relative to the recessed portion, with a linear shape pressure sensitive sensor, which is sensitive to a pressure from the vehicle exterior side relative to the recessed portion, being disposed within that hollow space.

4. The pinch detection device according to claim 1, wherein the first door front edge rubber includes a hollow space in a vehicle interior side relative to the recessed portion, with a linear shape pressure sensitive sensor, which is sensitive to a pressure from the vehicle interior side relative to the recessed portion, being disposed within the hollow space.

5. The pinch detection device according to claim 1, wherein the second door front edge rubber includes a hollow space in a rear position of the protrusion in the closing movement direction of the other sliding door, with a linear shape pressure sensitive sensor, that is sensitive to a pressure from the protrusion in the event of pinch in that closing movement direction, being disposed within that hollow space.

6. The pinch detection device according to claim 1, wherein the second door front edge rubber includes a hollow space in the vehicle exterior side relative to a rear position of the protrusion in the closing movement direction of the other sliding door, with a linear shape pressure sensitive sensor, that is sensitive to a pressure from the vehicle exterior side relative to the protrusion, being disposed within that hollow space.

7. The pinch detection device according to claim 1, wherein the second door front edge rubber includes a hollow space in the vehicle interior side relative to the rear position of the protrusion in the closing movement direction of the other sliding door, with a linear shape pressure sensitive sensor, that is sensitive to a pressure from the vehicle interior side relative to the protrusion, being disposed within that hollow space.

8. The pinch detection device according to claim 1, wherein the holding member is disposed on an exterior of a first door front edge rubber.

9. The pinch detection device according to claim 1, wherein the tip surface at least partially comes into contact with the holding portion during closing of the one pair of sliding doors.

* * * * *